US005439133A

United States Patent [19]

Stone

[11] Patent Number: 5,439,133

[45] Date of Patent: Aug. 8, 1995

[54] PAPERBOARD CARTON-LINER ASSEMBLY WITH BALANCING MEANS

[75] Inventor: James L. Stone, Grand Rapids, Mich.

[73] Assignee: Packaging Corporation of America, Evanston, Ill.

[21] Appl. No.: 248,481

[22] Filed: May 24, 1994

[51] Int. Cl.[6] ..... B65D 5/56

[52] U.S. Cl. ..... 220/418; 220/410; 229/117; 229/917

[58] Field of Search ..... 220/408, 410, 416, 418; 229/117, 917, 225

[56] References Cited

U.S. PATENT DOCUMENTS

| | | | |
|---|---|---|---|
| 3,708,108 | 1/1973 | Rosenburg, Jr. | 229/225 |
| 3,910,486 | 10/1975 | Stone . | |
| 3,963,173 | 6/1976 | Stone . | |
| 4,141,449 | 2/1979 | Stone . | |
| 4,732,315 | 3/1988 | Gunn . | |
| 4,773,542 | 9/1988 | Schillinger et al. . | |
| 4,981,256 | 1/1991 | Giblin et al. | 229/917 |
| 4,986,420 | 1/1991 | Gunn et al. . | |
| 5,036,982 | 8/1991 | Aston | 229/225 |
| 5,154,343 | 10/1992 | Stone . | |
| 5,161,733 | 11/1992 | Latif | 229/225 |
| 5,161,734 | 11/1992 | Ruehl et al. . | |
| 5,219,089 | 6/1993 | Kiolbasa et al. | 229/225 |
| 5,236,123 | 8/1993 | Stone et al. . | |
| 5,265,799 | 11/1993 | Stone . | |
| 5,325,989 | 7/1994 | Karalus | 229/225 |
| 5,373,960 | 12/1994 | Gunn et al. . | |

*Primary Examiner*—Gary E. Elkins
*Attorney, Agent, or Firm*—Arnold, White & Durkee

[57] ABSTRACT

A carton-liner assembly comprises a carton and a liner constructed and arranged for placement within the carton. The carton includes opposing top and bottom walls, opposing front and back walls, and opposing side walls. The liner includes a front panel and opposing side panels for fitting the liner within the carton. The liner front panel has an outer surface adjacent to an inner surface of the carton front wall. The carton-liner assembly further comprises a plurality of embossments integral with the liner and a plurality of debossments integral with the carton. The embossments and debossments are arranged to increase the thickness of the assembly in regions spaced from relatively thick portions of the assembly while the assembly is in flattened tubular form during production so as to counterbalance the thick portions of the assembly, thereby improving stackability of the assembly while the assembly is in flattened tubular form.

29 Claims, 6 Drawing Sheets

PAPERBOARD CARTON-LINER ASSEMBLY WITH BALANCING MEANS

FIELD OF THE INVENTION

The present invention relates generally to paperboard cartons and containers and the like. More specifically, the present invention relates to a paperboard carton-liner assembly having embossments or debossments on the liner and/or carton of the assembly. With the assembly in flattened tubular form during production, the embossments/debossments are spaced from thicker portions of the assembly to counterbalance these thicker portions, thereby improving stackability of the assembly during case packing and form-fill-seal operations.

BACKGROUND OF THE INVENTION

A typical carton-liner assembly includes a carton in the form a six-sided parallelopiped enclosure having opposing top and bottom walls, front and back balls, and side walls formed from corresponding panels and flaps defined on a unitary paperboard blank. The assembly further includes a liner constructed and arranged to fit within the carton. The liner has a front panel, opposing side panels, and, if desired, a partial or full back panel opposing the front panel. Furthermore, the liner may be either a full-height liner extending from the top wall to the bottom wall of the carton or a partial-height liner extending from the top wall of the carton to a location spaced away from the bottom wall of the carton. The assembly may be provided with a reclosure feature of the type described in U.S. Pat. Nos. 5,154,343, 5,265,799, and 5,314,114 to Stone. This reclosure feature employs an overhanging liner flap creating two layers of paperboard along the upper portion of the liner front panel. Moreover, the assembly may be provided with a handle extending along an upper portion of the front and side panels of the carton blank. The ends of the handle are attached to or protrude through the side panels of the carton blank.

The carton-liner assembly is manufactured using high speed packaging equipment. In particular, the carton and liner are formed from respective die-cut unitary blanks provided with working scores. A working score is defined herein as a score which permits the associated blank to be easily folded 180 degrees about the score during production of the assembly. After die-cutting the blanks, the liner blank is positioned over and adhered to the inner surface of the carton blank with the working scores of the liner blank approximately aligned with the working scores of the carton blank. Next, the liner and carton blanks are folded 180 degrees about the aligned working scores to create a finished, glued flat assembly in flattened tubular form.

With the carton-liner assembly in flattened tubular form, the assembly is stacked in a case along with other identical assemblies by hand or by using high-speed case packing equipment. After the case is shipped to a customer for form-fill-seal operations, the assembly is stacked once again with other such assemblies in the hopper of the form-fill-seal equipment. A drawback of the carton-liner assembly is that a plurality of the flattened tubular assemblies do not stack evenly if a partial-height liner, a reclosure feature, or a handle is employed on the carton-liner assembly. Each of the foregoing features increases the thickness of a flattened tubular assembly at the upper portion thereof, but not at the lower portion thereof. As a result, one portion of a stack of such carton-liner assemblies will be higher (vertical stack) or wider (horizontal stack) than another portion of the stack. This, in turn, may generate an imbricate (shingle) structure, cause a portion of the stack to sag, or cause some assemblies in the stack to separate themselves from the remainder of the stack. The stacking problems hinder case packing and form-fill-seal operations, thereby reducing manufacturing efficiency.

A need therefore exists for a carton-liner assembly which overcomes the aforementioned shortcomings associated with existing carton-liner assemblies.

SUMMARY OF THE INVENTION

In accordance with the foregoing, an object of the present invention is to provide a paperboard carton-liner assembly which improves stackability of the assembly during case packing and form-fill-seal operations, thereby facilitating manufacture of the carton-liner assembly.

In one particular embodiment, these and other objects are realized by providing a carton-liner assembly having an outer carton and a liner disposed therein. The carton of the liner-carton assembly is in the form of a six-sided parallelopiped enclosure having opposing top and bottom walls, front and back walls, and side walls formed from corresponding panels and flaps defined on a unitary, continuous paperboard blank. The side walls and the front wall are provided with horizontal tear-strip sections which define an integral and continuous tear strip that functions as convenient means for opening the carton-liner assembly from its sealed form. The liner of the carton-liner assembly includes a front panel and opposing side panels for fitting the liner snugly inside the carton.

The carton-liner assembly includes one or more of the following features which increases the thickness of an upper portion of the carton-liner assembly when it is in flattened tubular form during production: (1) a partial-height liner extending from the top wall of the carton to a location spaced away from the bottom wall of the carton; (2) a reclosure feature employing multiple layers of paperboard along the upper portion of the liner front panel; and (3) a handle extending between opposing side walls of the carton.

To counterbalance the increased thickness of the upper portion of the flattened carton-liner assembly, the lower portions of the liner and carton are provided with embossments or debossments for increasing the thickness of the lower portion of the flattened assembly. Embossments are raised portions on the surface of the paperboard, while debossments are depressed portions on the paperboard surface. If the liner is a partial-height liner, the embossments or debossments are formed on the carton because the liner stops short of the lower portion of the flattened assembly. The thickened lower portion of the flattened tubular assembly compensates in part or in whole for the additional thickness on the upper portion generated by the partial-height liner, the reclosure feature, or the handle.

BRIEF DESCRIPTION OF THE DRAWINGS

Other objects and advantages of the invention will become apparent upon reading the following detailed description and upon reference to the drawings in which.

Figure 1:
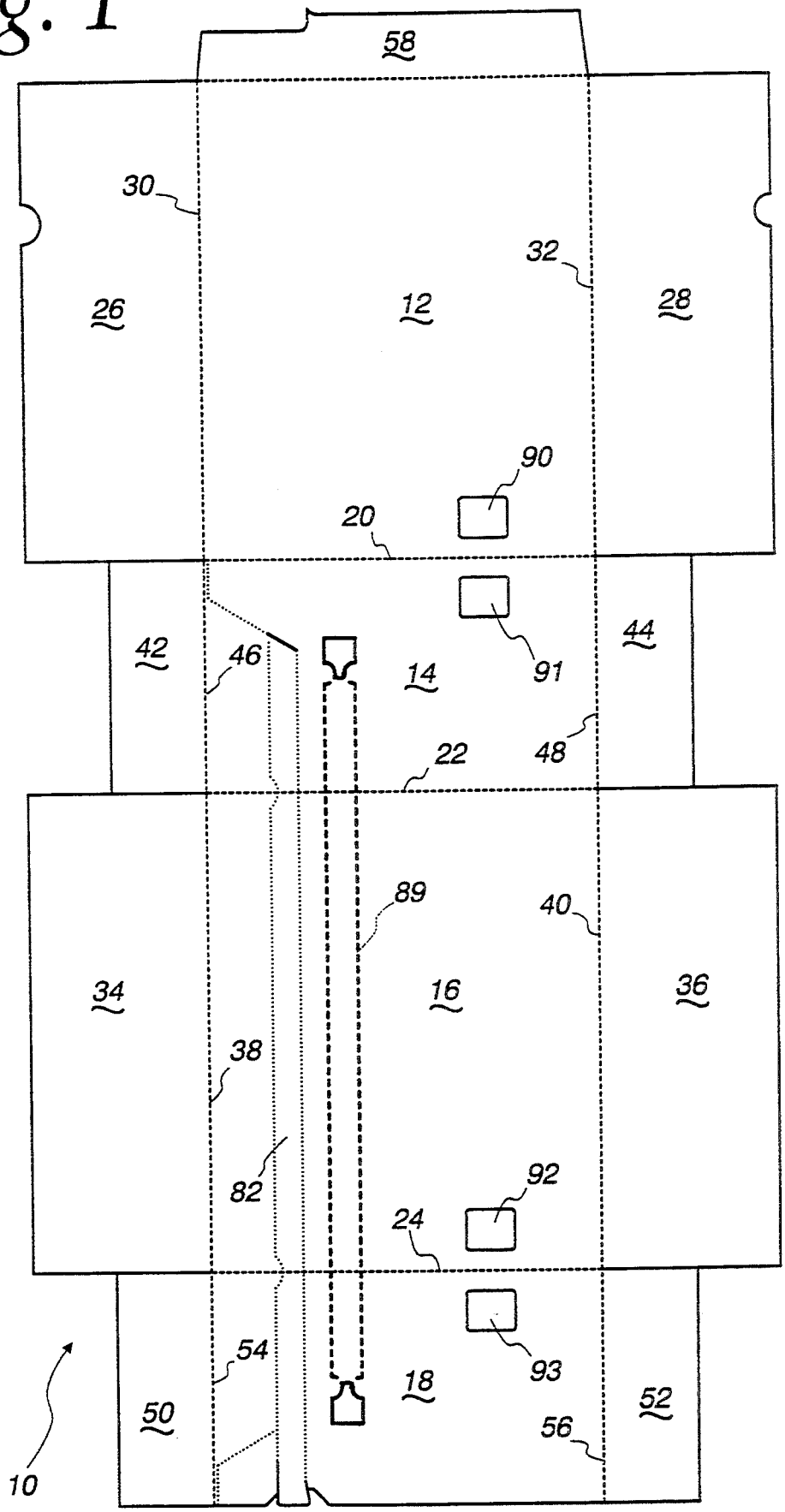
FIG. 1 is a plan view of the inside surface of a paperboard carton blank used to form the carton of the carton-liner assembly embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
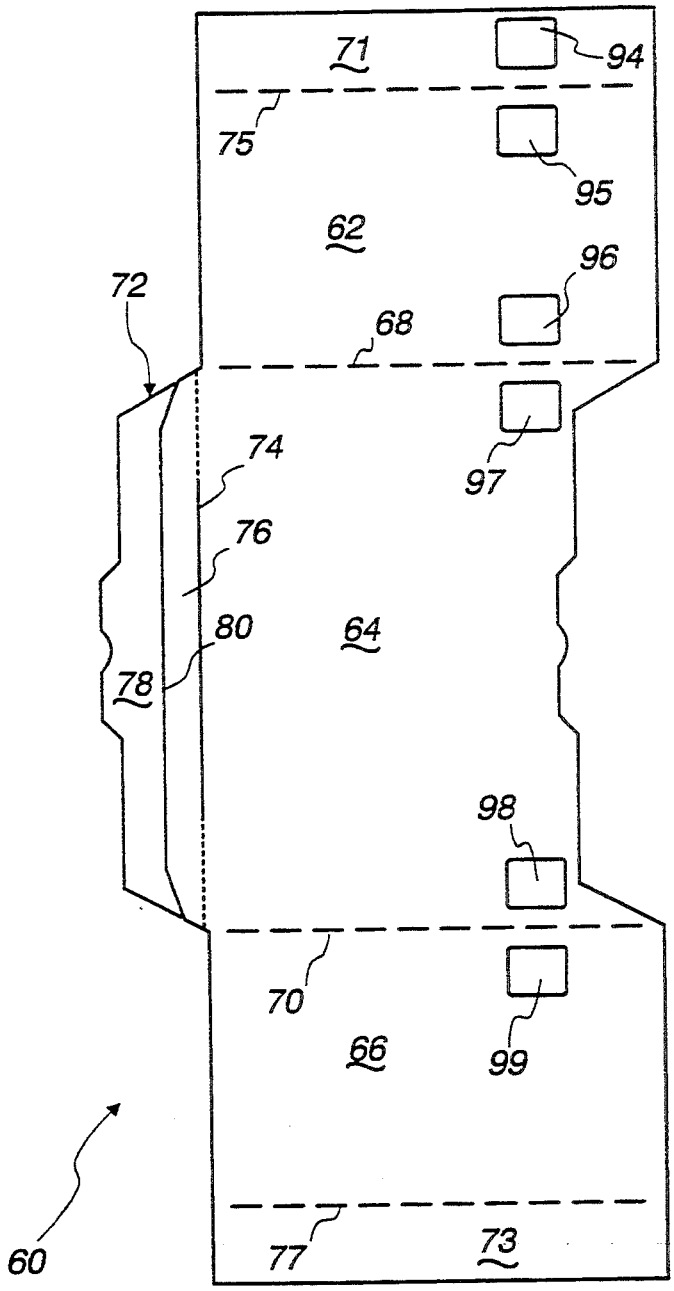
FIG. 2 is a plan view of the inside surface of a paperboard liner blank used to form the liner of the carton-liner assembly embodying the present invention.

Turning now to the drawings, FIGS. 1 and 2 illustrate respective carton and liner blanks for forming the carton-liner assembly embodying the present invention. The carton blank, depicted in FIG. 1 and generally designated by the reference numeral 10, includes four main rectangular panels 12, 14, 16, and 18 hingedly connected to each other about horizontal score lines. The panels 12, 14 are hingedly connected about a working score line 20, the panels 14, 16 are hingedly connected about a non-working score line 22, and the panels 16, 18 are hingedly connected about a working score line 24. With respect to the formed carton-liner assembly in FIG. 8, the panel 12 corresponds to the back wall of the outer carton, the panels 14, 18 correspond to the opposing side walls of the carton, and the panel 16 corresponds to the front wall of the carton.

Figure 8:
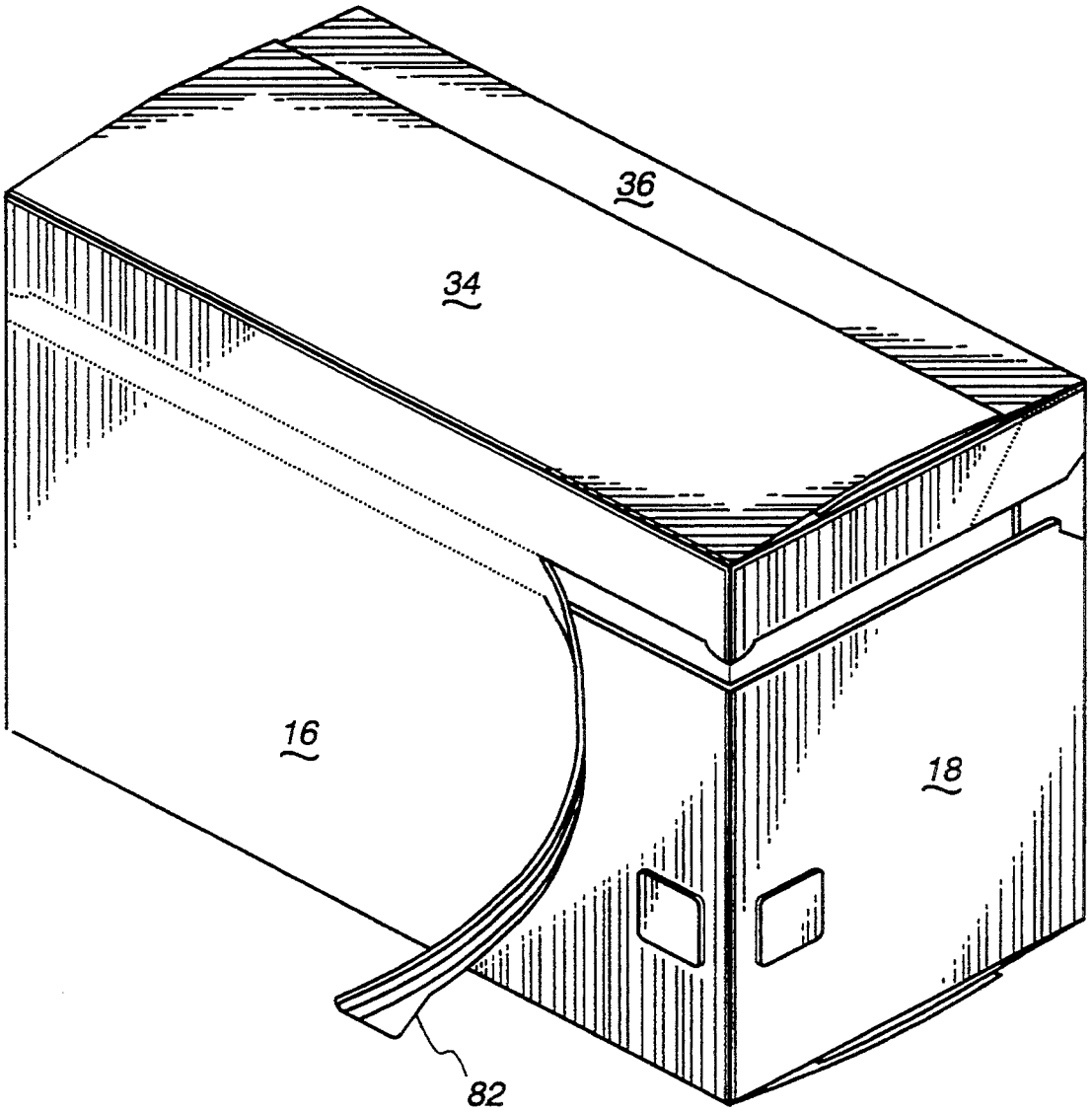
FIG. 8 is a perspective view of the reclosable paperboard carton-liner assembly embodying the present invention, the carton-liner assembly being shown in its closed form with the tear strip partially pulled open.

To form the top and bottom walls of the carton-liner assembly in FIG. 8, a plurality of flaps are hingedly connected to the four main panels 12, 14, 16, and 18 about vertical score lines. More specifically, inner top and bottom closure flaps 26, 28 are connected to the back panel 12 about respective vertical score lines 30, 32. Similarly, outer top and bottom closure flaps 34, 36 are connected to the front panel 16 about respective vertical score lines 38, 40. Top and bottom dust flaps 42, 44 are connected to the first side panel 14 about respective vertical score lines 46, 48, while dust flaps 50, 52 are connected to the second side panel 18 about respective vertical score lines 54, 56. With respect to the formed carton-liner assembly in FIG. 8, the inner and outer top closure flaps 26, 34 and the dust flaps 42, 50 form the top wall of the carton. Similarly, the inner and outer bottom closure flaps 28, 36 and the dust flaps 44, 52 form the bottom wall of the carton.

The liner blank is illustrated in FIG. 2 and is generally designated by the reference numeral 60. The liner blank 60 preferably includes at least three main panels 62, 64, and 66 hingedly connected to each other about horizontal score lines. The panels 62, 64 are connected about a non-working score line 68, while the panels 64, 66 are connected about a working score line 70. In the preferred embodiment, the liner blank 60 further includes a pair of narrow panels 71, 73 hingedly connected to the respective side panels 62, 66 about the respective horizontal score lines 75, 77. The score line 75 is a working score line, while the score line 77 is a non-working score line. With respect to the formed carton-liner assembly in FIG. 8, the panels 62, 66 bear against the respective side walls 14, 18 of the carton, and the panel 64 bears against the front wall 16 of the carton. The panels 71, 73 bear against the back wall 12 of the carton. In an alternative embodiment, the panels 71, 73 are substituted with a full back panel.

Figure 3:
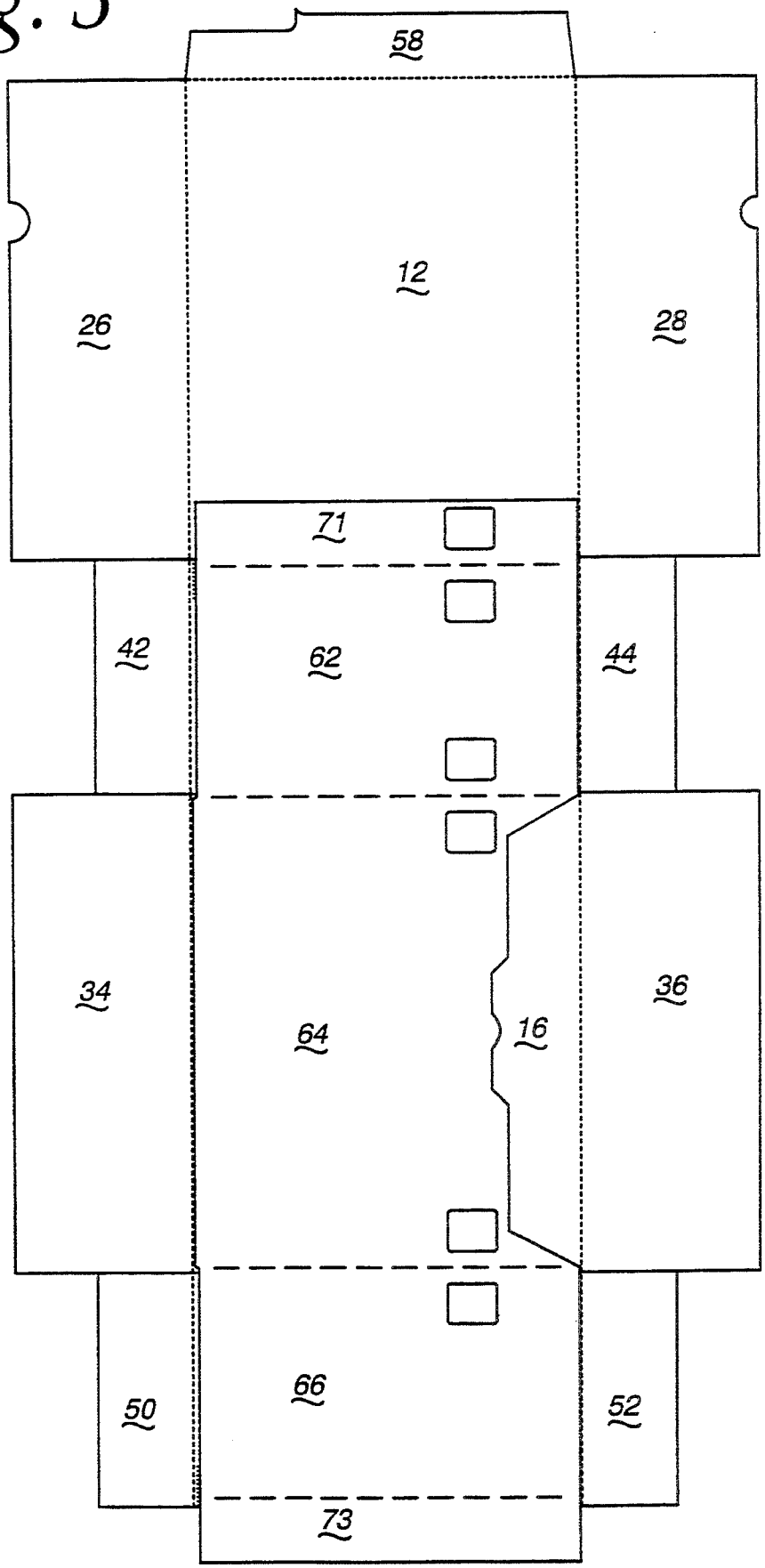
FIG. 3 is a plan view of the inside surfaces of the carton and liner blanks in FIGS. 1 and 2 with the liner blank positioned over and adhered to the carton blank.

In the preferred embodiment, the carton-liner assembly includes a reclosure feature realized by providing the liner blank 60 with an extension flap 72 hingedly connected to the front panel 64 about a vertical score line 74. The extension flap 72 includes a proximal flap 76 and an island portion 78 detachably connected to the proximal flap 76 by means of weakening nicks 80. Prior to adhering the liner blank 60 to the carton blank 10 as shown in FIG. 3, glue is applied to the inner surface of the island portion 78 (surface shown in FIG. 2) and the extension flap 72 is hingedly rotated downwardly and inwardly about the vertical score line 74 so that the extension flap 72 is interposed between the carton front panel 16 and the liner front panel 64. The glue on the island portion 78 fixedly attaches the island portion 78 to the inner surface of the carton front panel 16 to the left of a conventional tear strip 82 (as viewed in FIG. 1). Prior to removing the tear strip 82 of the carton-liner assembly (see FIG. 8), the island portion 78 is connected to the proximal flap 76 by means of weakening nicks 80 and is fixedly attached to the inner surface of the carton front panel 16 above the tear strip 82 by adhesive means such as glue.

Tearing or pulling away of the tear strip 82 effectively delineates the carton of the assembly into a bottom base portion and an upper lid portion. The arrangement is such that, once the tear strip 82 has been completely pulled away, the carton lid can be swung or raised upwardly away from the carton base by virtue of a hinged attachment of the lid to the base along the upper edge of the carton back panel 12. Raising the carton lid breaks the weakening nicks 80 between the island portion 78 and the proximal flap 76 such that the island portion 78 is separated from the proximal flap 76. The island portion 78 remains attached to the inner surface of the front portion of the carton lid. When the carton lid is reclosed, the island portion 78 snappingly re-engages the proximal flap 76 so as to lock the lid to the base section of the carton. This snap re-engagement is accompanied by positive tactile and audible feedback indicative of effective reclosure.

Figure 4:
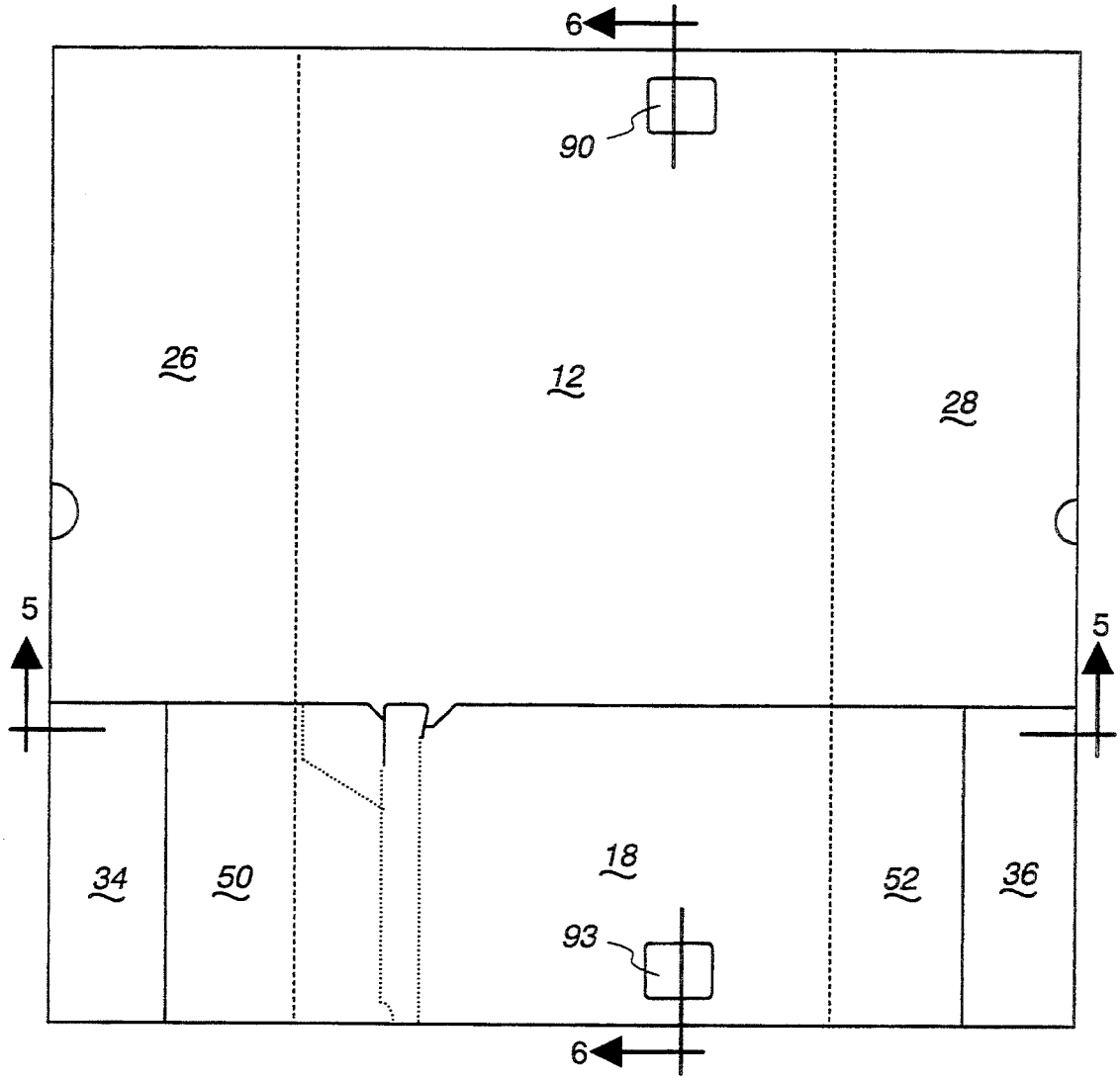
FIG. 4 is a plan view of the carton and liner blanks folded about the working scores to form the carton-liner assembly in flattened tubular form.

After the liner blank 60 is positioned over and adhered to the carton blank 10 as illustrated in FIG. 3, the carton and liner blanks are folded about the working scores 20, 24, 75, and 70 to form the carton-liner assembly in the flattened tubular form illustrated in FIG. 4.

More specifically, the side panel 66 of the liner blank 60 is first hingedly rotated 180 degrees about the working score 70 so that the inner surfaces of the liner side panel 66 and the liner back panel 73 bear against the inner surface of the liner front panel 64. Next, back panel 12 of the carton blank 10 is hingedly rotated 180 degrees about the working score 20 so that the inner surface of a carton glue flap 58 bears against the outer surface of the liner side panel 66. This rotation of the carton back panel 12 causes simultaneous rotation of the back panel 71 of the liner blank 60 about the working score 75, which is aligned with the working score 20. Finally, the side panel 18 of the carton blank 10 is hingedly rotated 180 degrees about the working score 24 so that a portion of the inner surface of the carton side panel 18 bears against the outer surface of the carton glue flap 58. Since the glue flap 58 has glue applied thereto, the carton side panel 18 is adhered to the glue flap 58 so as to maintain the assembly in flattened tubular form.

Figure 5:
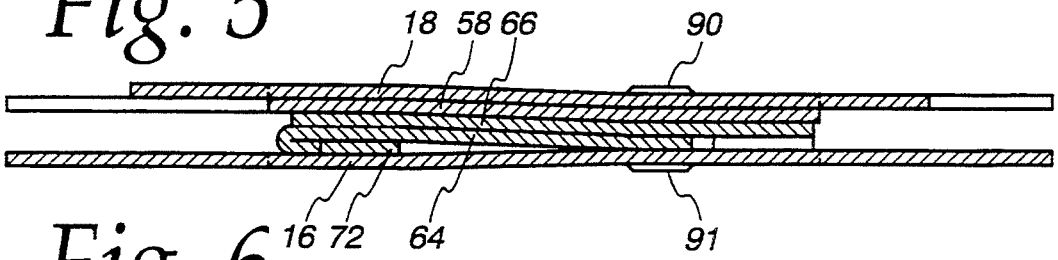
FIG. 5 is a section taken generally along line 5—5 in FIG. 4.

As best shown in FIG. 5, due to the extension flap 72 of the reclosure feature, the paperboard thickness of the left portion of the flattened tubular assembly in FIG. 4 is greater than the paperboard thickness of the right portion of the flattened tubular assembly. In particular, the left portion of the section view in FIG. 5 is composed of six layers of paperboard, including the carton front panel 16, the extension flap 72, the liner front panel 64, the liner side panel 66, the glue flap 58, and carton side panel 18. Moreover, the outward bias of the extension flap 72 away from the liner front panel 64 increases the separation between the liner front panel 64 and the carton front panel 16, thereby effectively increasing the thickness of the assembly along the left portion thereof. On the other hand, the right portion of the section view in FIG. 5 is composed of only five layers of paperboard, including the carton front panel 16, the liner front panel 64, the liner side panel 66, the glue flap 58, and carton side panel 18.

The present invention counterbalances the increased thickness of the left portion of the flattened tubular assembly by providing embossments and debossments on the right portions of both the carton blank 10 and the liner blank 60 (as viewed in FIGS. 1–4). The carton blank 10 in FIG. 1 is provided with debossments 90–93 for increasing the thickness of the assembly at external locations, while the liner blank 60 is provided with embossments 94–99 for increasing the thickness of the assembly at internal locations. The foregoing embossments and debossments on the right portion of the flattened tubular assembly compensate for the extension flap 72 along left portion of the flattened tubular assembly.

Figure 6:
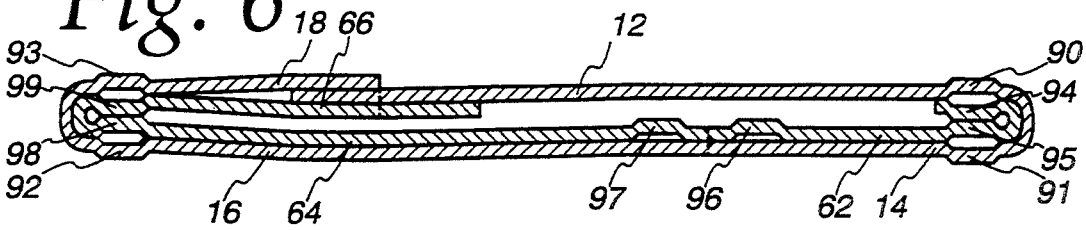
FIG. 6 is a section taken generally along line 6—6 in FIG. 4.

To maximize the effectiveness of the embossments and debossments, they are primarily disposed in aligned pairs when the assembly is in flattened tubular form (FIG. 4). For example, as best shown in FIG. 6, the debossments 90, 91 are aligned with each other and the debossments 92, 93 are aligned with each other. When the flattened tubular assembly is stacked adjacent a substantially identical flattened tubular assembly, the debossment 90 on the carton back panel 12 bears directly against the debossment 91 on the carton side panel 14 of the adjacent assembly so as increase the separation between the two assemblies at the location of the debossments. Similarly, the debossment 93 on the carton side panel 18 abuts the debossment 92 on the carton front panel 16 of the adjacent assembly.

While the debossments 90–93 operate external to the flattened tubular assembly, the embossments 94–99 are increase the thickness of the assembly at internal locations on the right portion thereof. The embossments 94, 95 are aligned with each other and the embossments 98, 99 are aligned with each other. As depicted in FIG. 6, the embossment 94 on the liner back panel 71 bears directly against the embossment 95 on the liner side panel 62, thereby increasing the separation between these two panels at the location of the embossments. The embossments 98, 99 increase the separation between the respective liner front panel 64 and the liner side panel 66 in similar fashion. Although the embossments 96, 97 are not aligned with each other when the assembly is in flattened tubular form, these two embossments effectively support the carton back panel 12 to prevent substantial sagging in a region where there is less paperboard build-up.

With a plurality of flattened tubular assemblies stacked vertically or horizontally adjacent each other, the embossments and debossments insure that the assemblies will stack evenly without shingling or sagging. The embossments and debossments are located at positions spaced from the left portion of the assembly to counterbalance the thickening effects of the extension flap 72. The degree of counterbalance provided by the embossments and debossments is determined by the depth thereof. The greater the depth of the embossments and debossments, the thicker the assembly at the locations of the embossments and debossments. The maximum depth of each embossment or debossment is approximately equal to the thickness of one layer of paperboard. For example, if the paperboard has a thickness of 0.020 inches (i.e., 20 point paperboard), then the approximate maximum depth of the embossments or debossment is 0.020 inches.

The actual depth of the embossments and debossments is chosen such that the thickness of the right portion of the flattened tubular assembly is approximately equal to the thickness of the left portion of the flattened tubular assembly. In the preferred embodiment, the depths of the embossments and debossments range from approximately 40 percent to 70 percent of the thickness of the paperboard. For instance, the depth of each embossment and debossment may be approximately 50 percent of the thickness of the paperboard. In this case, the embossments 96, 97 each effectively increase the thickness of the assembly by approximately one-half layer of paperboard at the locations thereof. Furthermore, since the debossments 90, 91 and embossments 94, 95 are aligned with each other, they combine to effectively increase the thickness of the assembly by approximately two layers of paperboard at the location thereof. Similarly, the debossments 92, 93 and embossments 98, 99 combine to effectively increase the thickness of the assembly by approximately two layers of paperboard at the location thereof. In an alternative embodiment, the debossment 92 on the carton front panel 16 is removed in order to prevent any interference with graphics on the outer surface of the carton front panel 16. To compensate for the removed debossment, the depth of one or more of the debossment 93 and embossments 98, 99 is increased.

If the structure of the carton-liner assembly is modified, the depth and locations of the embossments and debossments may be modified to equalize any imbalance in the thickness of the flattened tubular assembly over different portions thereof. For example, the carton-liner assembly may be modified to include a carry handle with or without the reclosure feature (extension flap 72). The handle is depicted with dotted lines in FIG. 1 and is designated by the reference numeral 89. In the flattened tubular form of the carton-liner assembly (FIG. 4), the plastic or paperboard handle 89 (not shown in FIG. 4) extends across the left portion of the assembly adjacent and parallel to the tear strip 82. The handle 89 extends from the first carton side panel 14, across the carton front panel 16, and to the second carton side panel 18. Like the extension flap 72 on the liner blank 60, the handle 89 increases the effective thickness of the left portion of the flattened tubular assembly. The thickness of the lower left portion (as viewed in FIG. 4) of the assembly is even further increased because section of the handle on opposite sides of the working score 24 overlap each other. To counteract the increased thickness provided by the handle on the left and lower left portions of the assembly, embossments and debossments of appropriate depth are located on both the upper left portion and the right portion of the assembly. If the assembly includes both the reclosure feature and the handle, the depths of the embossments and debossments are accordingly increased to compensate for the additional thickness provided by both the extension flap 72 and the handle.

Figure 7:
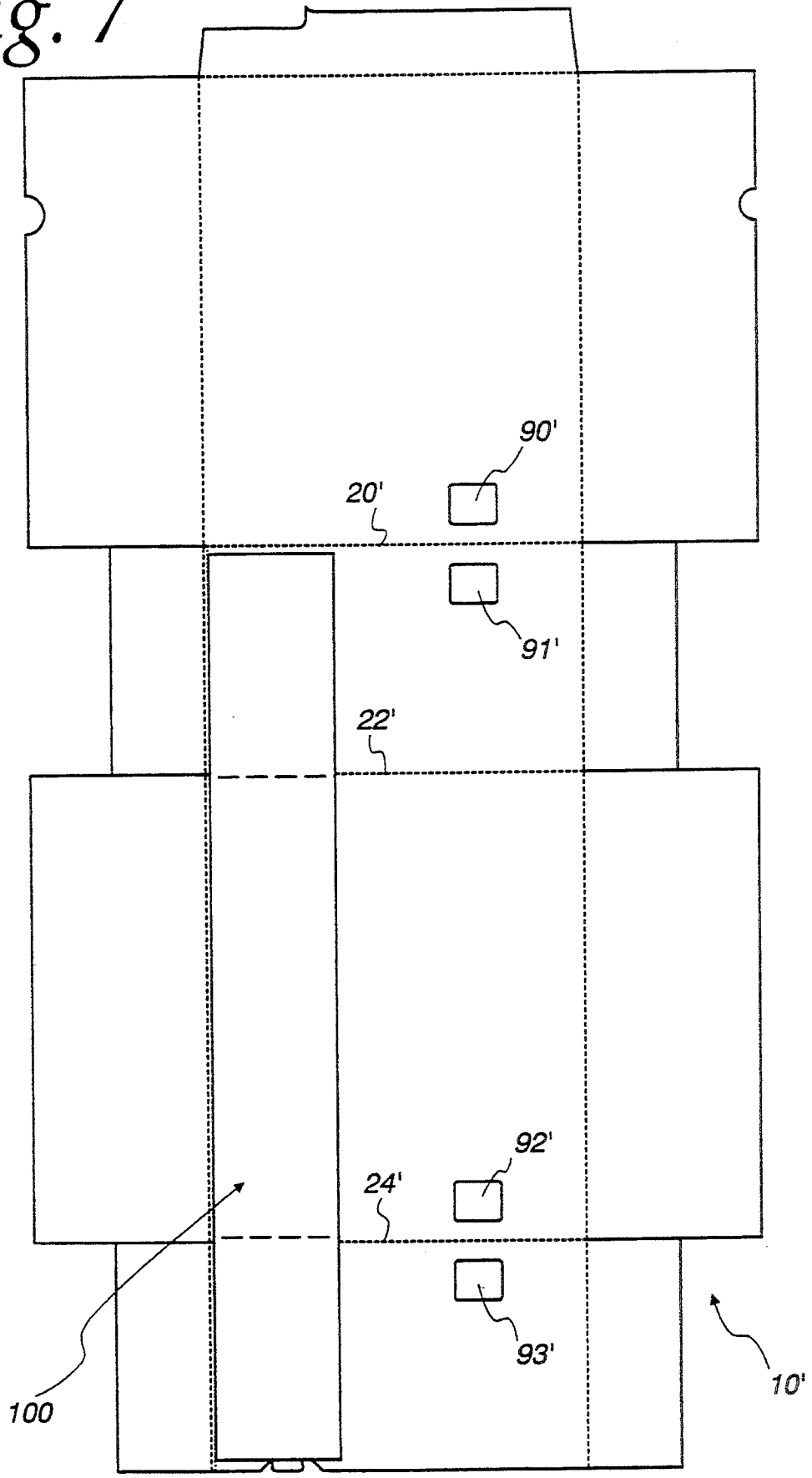
FIG. 7 is a plan view of the inside surfaces of carton and liner blanks, in accordance with an alternative embodiment of the present invention, for a carton-liner assembly employing a partial-height liner.

In another alternative embodiment, the full-height liner blank is substituted with a partial-height liner blank 100 as depicted in FIG. 7. Although the illustrated partial-height liner blank 100 is not provided with an extension flap for effecting a reclosure feature as described above, the blank 100 may be modified to include such an extension flap. If desired, the assembly may further include a handle (not shown). Due to the partial-height liner blank 100 along the left portion of the assembly in FIG. 7, the paperboard thickness of the left portion of the assembly is greater than the paperboard thickness of the right portion of the assembly. To offset the increased thickness of the left portion caused by the partial-height liner blank 100, the carton blank 10' is provided with a first pair of embossments 90', 91' and a second pair of embossments 92', 93'. The first pair of embossments 90', 91' are located on opposite sides of the working score 20' and bear directly against each other when the assembly is in flattened tubular form. Similarly, the second pair of embossments 92', 93' are located on opposite sides of the working score 24' and bear directly against each other when the assembly is in flattened tubular form. A third pair of embossments may be provided on opposite sides of the non-working score 22' to prevent any potential sagging which might occur in this area while stacking multiple assemblies. The depths of the embossments typically range from 40 percent to 70 percent of the thickness of the paperboard and are chosen to effectively counterbalance the additional thickness of the left portion of the assembly resulting from the partial-height liner blank 100. If the assembly further includes a reclosure feature (extension flap) and/or a handle, the depths of the embossments are accordingly increased.

While the present invention has been described with reference to one or more particular embodiments, those skilled in the art will recognize that many changes may be made thereto without departing from the spirit and scope of the present invention.

For example, the carton-liner assembly may include a pour spout mounted in one of the side walls of the assembly. Like the reclosure feature, handle, and partial-height liner, the pour spout increases the thickness of the assembly at the location thereof. Embossments and debossments are formed at locations on the liner blank and/or carton blank to counterbalance the increased thickness of the assembly at the location of the pour spout.

In another embodiment, the embossments on the liner are substituted with debossments, and the debossments on the carton are substituted with embossments.

In yet another embodiment, portions of the working scores 20, 24 in the carton blank 10 are formed as either "fluff" scores or double-scores. With a pair of carton panels connected about each working score, the fluffed or double-scored portion of each working score increases the separation between the associated pair of carton panels at the location of the fluffed or double-scored portion. By locating the fluffed or double-scored portions of the working scores at locations where there is less paperboard build-up, the fluffed or double-scored portions counterbalance other portions of the flattened tubular assembly.

In a further embodiment, the carton and liner are formed from a unitary blank of the type illustrated in U.S. Pat. No. 5,314,114 to Stone, entitled FLIP-TOP RECLOSEABLE CARTON WITH POSITIVE CLOSURE ARRANGEMENT or of the type illustrated in U.S. Pat. No. 5,154,343 to Stone, entitled FLIP-TOP RECLOSEABLE CARTON WITH POSITIVE CLOSURE ARRANGEMENT, which are incorporated herein by reference. The embossments and debossments are arranged on the blank so as to counterbalance relatively thick portions of the flattened tubular assembly formed from the unitary blank.

Each of these embodiments and obvious variations thereof is contemplated as falling within the spirit and scope of the claimed invention, which is set forth in the following claims.

What is claimed is:

1. A carton-liner assembly, comprising:

a carton including opposing top and bottom walls, opposing front and back walls, and opposing side walls;

a liner constructed and arranged for placement within said carton and including a front panel and opposing side panels for fitting said liner within said carton, said front panel having an outer surface adjacent to an inner surface of said carton front wall; and first balancing means, integral with said liner, for increasing the thickness of the assembly in regions spaced from relatively thick portions of the assembly while the assembly is in flattened tubular form during production so as to counterbalance said thick portions of the assembly, thereby improving stackability of the assembly while the assembly is in flattened tubular form.

2. The assembly of claim 1, wherein said liner further includes an extension flap disposed adjacent an upper portion of said liner front panel, one of said relatively thick portions of the assembly being caused by said extension flap.

3. The assembly of claim 2, wherein said carton side walls and said carton front wall include a contiguous horizontal tear strip for opening up said carton from a sealed form to form a lid hingedly attached to a base section, and wherein said extension flap includes a locking flap and an island portion disposed in forcibly displaceable mutual engagement such that opening said carton lid exerts a force which disengages the mutual engagement between said locking flap and said island portion, and reclosing said lid leads to snap re-engagement of said locking flap and said island portion.

4. The assembly of claim 3, wherein said liner and said carton are assembled such that said island portion is fixedly attached to an inner surface of said carton lid and at the same time separatably attached to said locking flap, and wherein opening of said lid separates said island portion from said locking flap while retaining said locking flap adjacent said liner front panel.

5. The assembly of claim 1, further including second balancing means, integral with said carton, for increasing the thickness of the assembly in regions spaced from said thick portions of the assembly while the assembly is in flattened tubular form so as to counterbalance said thick portions of the assembly, thereby improving stackability of the assembly while the assembly is in flattened tubular form.

6. The assembly of claim 1, wherein said first balancing means are a plurality of embossments formed on a lower portion of said liner.

7. The assembly of claim 6, wherein said plurality of embossments include a pair of embossments arranged to bear directly against each other while the assembly is in flattened tubular form.

8. The assembly of claim 5, wherein said second balancing means are a plurality of debossments formed on a lower portion of said carton.

9. The assembly of claim 8, wherein said first balancing means are a plurality of embossments formed on a lower portion of said liner.

10. The assembly of claim 9, wherein said plurality of embossments include a pair of embossments arranged to abut each other while the assembly is in flattened tubular form.

11. The assembly of claim 10, wherein one of said plurality of debossments is aligned with said abutting pair of embossments while the assembly is in flattened tubular form.

12. The assembly of claim 8, wherein said plurality of debossments include a pair of debossments arranged to align with each other while the assembly is in flattened tubular form.

13. The assembly of claim 10, wherein said plurality of debossments include a pair of debossments arranged to align with each other and with said abutting pair of embossments while the assembly is in flattened tubular form.

14. The assembly of claim 1, further including a handle extending along an upper portion of said carton beneath said tear strip while the assembly is in flattened tubular form, one of said relatively thick portions of the assembly being caused by said handle.

15. The assembly of claim 14, wherein opposing ends of said handle are connected to said respective opposing side walls.

16. The assembly of claim 1, wherein said carton and said liner are formed from separate blanks.

17. A carton-liner assembly, comprising:

a carton including opposing top and bottom walls, opposing front and back walls, and opposing side walls, said side walls and front wall including a contiguous horizontal tear strip for opening up said carton from a sealed form to form a lid hingedly attached to a base section;

a partial-height liner constructed and arranged for placement within said carton and including a front panel and opposing side panels for fitting said liner within said carton, said front panel having an outer surface adjacent to an inner surface of said carton front wall, said liner extending from said carton top wall to a location spaced away from said carton bottom wall; and balancing means, integral with said carton, for increasing the thickness of the assembly in regions spaced from said partial-height liner while the assembly is in flattened tubular form during production so as to counteract the increased thickness provided to the assembly by said liner, thereby improving stackability of the assembly while the assembly is in flattened tubular form.

18. The assembly of claim 17, wherein said balancing means are a plurality of embossments formed on a lower portion of said carton beneath said partial-height liner.

19. The assembly of claim 18, wherein said plurality of embossments include a pair of embossments arranged to abut each other while the assembly is in flattened tubular form.

20. An arrangement for increasing the thickness of a portion of a carton-liner assembly while the assembly is in flattened tubular form, the carton-liner assembly in erected form including a carton having opposing top and bottom walls, opposing front and back walls, and opposing side walls, the assembly further including a liner constructed and arranged for placement within the carton and including a front panel and opposing side panels for fitting the liner within the carton, the front panel having an outer surface adjacent to an inner surface of the carton front wall, the arrangement comprising:

first balancing means integral with the liner; and second balancing means integral with the carton, said first and second balancing means increasing the thickness of the assembly in regions spaced from relatively thick portions of the assembly while the assembly is in flattened tubular form during production so as to counterbalance said thick portions of the assembly, thereby improving stackability of the assembly while the assembly is in flattened tubular form.

21. The arrangement of claim 20, wherein said first balancing means include a plurality of embossments formed on the liner, and wherein said second balancing means include a plurality of debossments formed on the carton.

22. The arrangement of claim 21, wherein said plurality of embossments include a pair of embossments arranged to abut each other while the assembly is in flattened tubular form.

23. The arrangement of claim 22, wherein said plurality of debossments include a debossment arranged to align with said abutting pair of embossments while the assembly is in flattened tubular form.

24. The arrangement of claim 22, wherein said plurality of debossments include a pair of debossments arranged to align with each other while the assembly is in flattened tubular form.

25. The arrangement of claim 22, wherein said plurality of debossments include a pair of debossments arranged to align with each other and with said abutting pair of embossments while the assembly is in flattened tubular form, said abutting pair of embossments being disposed between said aligned pair of debossments.

26. The arrangement of claim 22, wherein said abutting pair of embossments are located on opposite sides of a working score connecting said liner front panel and one of said liner side panels.

27. The arrangement of claim 26, wherein said plurality of embossments include a third embossment, in addition to said abutting pair of embossments, located on the other of said liner side panels.

28. The arrangement of claim 24, wherein said aligned pair of debossments are located on opposite sides of a working score connecting said carton back wall and one of said carton side walls.

29. The arrangement of claim 28, wherein said plurality of debossments include a third debossment, in addition to said aligned pair of debossments, located on the other of said carton side walls.

* * * * *